US012065294B2

(12) United States Patent
Bandinu

(10) Patent No.: US 12,065,294 B2
(45) Date of Patent: Aug. 20, 2024

(54) PACKAGING SYSTEM

(71) Applicant: NAKURU S.R.L., Pescara (IT)

(72) Inventor: Angelo Bandinu, Francavilla al Mare (IT)

(73) Assignee: NAKURU S.R.L., Pescara (IT)

( * ) Notice: Subject to any disclaimer, the term of this patent is extended or adjusted under 35 U.S.C. 154(b) by 0 days.

(21) Appl. No.: 17/700,560

(22) Filed: Mar. 22, 2022

(65) Prior Publication Data

US 2022/0315276 A1 Oct. 6, 2022

(30) Foreign Application Priority Data

Mar. 31, 2021 (IT) ..... 102021000008003

(51) Int. Cl.
*B65D 5/50* (2006.01)

(52) U.S. Cl.
CPC ..... *B65D 5/5052* (2013.01); *B65D 5/5004* (2013.01)

(58) Field of Classification Search
CPC .. B65D 5/5038; B65D 5/5061; B65D 5/5045; B65D 5/5059; B65D 85/305;
(Continued)

(56) References Cited

U.S. PATENT DOCUMENTS 1,673,956 A * 6/1928 Barnes ..... B65D 5/5045 206/433
3,752,301 A * 8/1973 Bluemel ..... B65D 5/5045 206/583
(Continued)

FOREIGN PATENT DOCUMENTS

DE 202007014159 U1 2/2009
EP 1125850 A1 8/2001
(Continued)

OTHER PUBLICATIONS

Search Report issued Dec. 1, 2021 in Italian Patent Application No. 202100008003, 2 pages.

*Primary Examiner* — Steven A. Reynolds
*Assistant Examiner* — Prince Pal
(74) *Attorney, Agent, or Firm* — Element IP, PLC

(57) ABSTRACT

The present invention relates to a packaging system for transporting delicate goods, such as glass bottles. According to the present invention, the improved packaging system (10) comprises an outer box (1) and an inner portion (2) configured for interacting with each other, said outer box developing in height along a direction Y, in width along a direction X and in depth along a direction Z, said inner portion comprising one or more support inserts (21, 22) complementary to said outer box (1), said inserts (21, 22) being configured for supporting one or more objects (100) in such a way as to prevent movement thereof with respect to said outer box (1), in particular with respect to said directions X and Z, said packaging system (10) being characterized in that it comprises at least one interposition element (3) between said outer box (1) and said inner portion (2) so as to prevent movement along said direction Y of the assembly formed by said support inserts (21, 22) and said objects (100) with respect to said outer box (1), said support inserts (21, 22) and said at least one interposition element (3) comprising coupling means (23, 24, 33) for their mutual coupling.

10 Claims, 11 Drawing Sheets

(58) Field of Classification Search
CPC .. B65D 71/72; B65D 5/5035; B65D 77/0426; B65D 5/5004; B65D 5/503; B65D 5/5042
USPC ..... 206/433, 589, 427, 499, 509, 562, 139, 206/443, 486, 485; 221/305
See application file for complete search history.

(56) References Cited

U.S. PATENT DOCUMENTS

| | | | | | |
|---|---|---|---|---|---|
| 3,804,234 | A * | 4/1974 | Gordon | B65D 5/50 | 229/185.1 |
| 4,671,405 | A * | 6/1987 | Hagan | B65D 21/0209 | 206/139 |
| 4,850,478 | A * | 7/1989 | Kidd | B65D 71/46 | 206/427 |
| 5,590,786 | A * | 1/1997 | Jaycox | B65D 77/0426 | 206/521 |
| 5,720,390 | A * | 2/1998 | Bostelman | B65D 5/5038 | 206/589 |
| 5,845,776 | A * | 12/1998 | Galbierz | B65D 71/48 | 206/427 |
| 6,702,115 | B1 * | 3/2004 | Roper | B65D 5/5061 | 206/427 |
| 7,546,921 | B2 * | 6/2009 | Evans | B65D 71/72 | 206/393 |
| 8,091,705 | B1 * | 1/2012 | McCutchen | B65D 5/5061 | 206/763 |
| 8,230,997 | B1 * | 7/2012 | McWilliams | B65D 5/5038 | 206/139 |
| 8,434,620 | B2 * | 5/2013 | Hall | B65B 5/08 | 220/532 |
| 8,701,884 | B2 * | 4/2014 | Williams | B65D 81/113 | 206/139 |
| 10,507,950 | B2 * | 12/2019 | Carrier | B65D 5/5045 | |
| D871,924 | S * | 1/2020 | Vanderwell | D9/755 | |
| 10,669,195 | B2 * | 6/2020 | Abbott, Jr. | B08B 9/42 | |
| 10,994,889 | B1 * | 5/2021 | Rumsam | B65D 5/5028 | |
| 11,261,015 | B2 * | 3/2022 | Gilligan | B65D 85/305 | |
| 11,420,786 | B1 * | 8/2022 | Ansola, III | B65D 71/72 | |
| 11,427,376 | B2 * | 8/2022 | Vanderwell | B65D 5/5061 | |
| 11,518,605 | B1 * | 12/2022 | Schnell | B65D 81/133 | |
| 11,643,268 | B2 * | 5/2023 | Chung | B65D 71/506 | 206/433 |
| 11,655,065 | B2 * | 5/2023 | Simpkins | B65D 5/5011 | 206/588 |
| 11,820,574 | B2 * | 11/2023 | Zhou | B65D 25/108 | |
| 2010/0326858 | A1 * | 12/2010 | Williams | B65D 85/305 | 206/429 |
| 2013/0008817 | A1 * | 1/2013 | Colligan | B65D 5/5059 | 206/419 |
| 2013/0313145 | A1 * | 11/2013 | Gilfert | B65D 5/5088 | 53/472 |
| 2014/0102934 | A1 * | 4/2014 | Gatto | B65D 85/42 | 53/411 |
| 2014/0363555 | A1 * | 12/2014 | Simpson | B65D 5/5038 | 426/420 |
| 2015/0210457 | A1 * | 7/2015 | DiMauro | B65B 61/207 | 53/472 |
| 2016/0167857 | A1 * | 6/2016 | Liu | B65D 5/04 | 229/103.2 |
| 2019/0177031 | A1 * | 6/2019 | Vanderwell | B65D 5/5038 | |
| 2021/0130059 | A1 * | 5/2021 | Hurley | B65D 71/46 | |
| 2022/0144519 | A1 * | 5/2022 | Gilligan | B65D 81/133 | |
| 2023/0159255 | A1 * | 5/2023 | Gilligan | B65D 5/5028 | 206/433 |

FOREIGN PATENT DOCUMENTS

| | | | |
|---|---|---|---|
| FR | 1216494 | A | 4/1960 |
| WO | WO-2015049702 | A1 | 4/2015 |

* cited by examiner

PACKAGING SYSTEM

The present application claims priority of the Italian patent application no IT102021000008003, the content of which is incorporated herein by reference.

The present invention relates to a packaging system for transporting fragile goods, such as glass bottles.

As is well known, the transport of these types of fragile products is a rather delicate matter as there is a high risk of collision between them within the packaging system adopted, but there are objectively also external causes such as the accidental dropping of the packaging that can cause the breakage of the transported products resulting in extreme economic damages to the entire supply chain.

In addition, when transporting bottles of beverages, such as wines, spirits or water, glass bottles have a considerable weight which increases the risk of breakage in case of accidental shocks or bumps between them.

Therefore, in the course of time, various packaging solutions have been devised that allow transporting bottles while decreasing the risk of breakage.

A classic example is the use of polystyrene or polystyrene beehives which allow to cushion possible shocks, both internal between the bottles and external as a consequence of accidental drops.

Although functional in terms of safety during transport, these systems are not very efficient from a logistical point of view since, even when not in use, they take up large spaces for storage thereof.

In addition, these solutions involve the use of materials that are not eco-sustainable and difficult to dispose of even by the end users.

Lately more and more cardboard packaging solutions with inner structures configured for supporting the bottles are being used.

An example of such packagings is set forth in the U.S. Pat. No. 6,702,115, in which a series of inserts are used along the entire vertical axis with the purpose of distancing the bottles from each other allowing total protection.

In any case, such a solution, is scarcely efficient from the functional point of view because using a large number of components to assemble is extremely complex.

In addition, the correct assembly sequence must be followed for the packaging system to function properly.

The result is a safe system, but with very long assembly times and a necessary and appropriate technical preparation on assembly operations by an operator.

In addition, this system uses large amounts of material making it economically expensive and also likely to generate large amounts of waste, which is not efficient from an environmental point of view.

The object of the present invention is to obviate all of these drawbacks mentioned above, and in particular to devise an improved packaging which secures glass bottles from any damage during transport, but which at the same time uses the least amount of material as possible and is faster and easier to assemble.

These and other objects according to the present invention are achieved by making an improved packaging as set forth in claim 1.

Further features of the device are the object of the dependent claims.

The features and advantages of an improved packaging according to the present invention will be more apparent from the following description, which is to be understood as exemplifying and not limiting, with reference to the schematic attached drawings, wherein.

Figure 1:
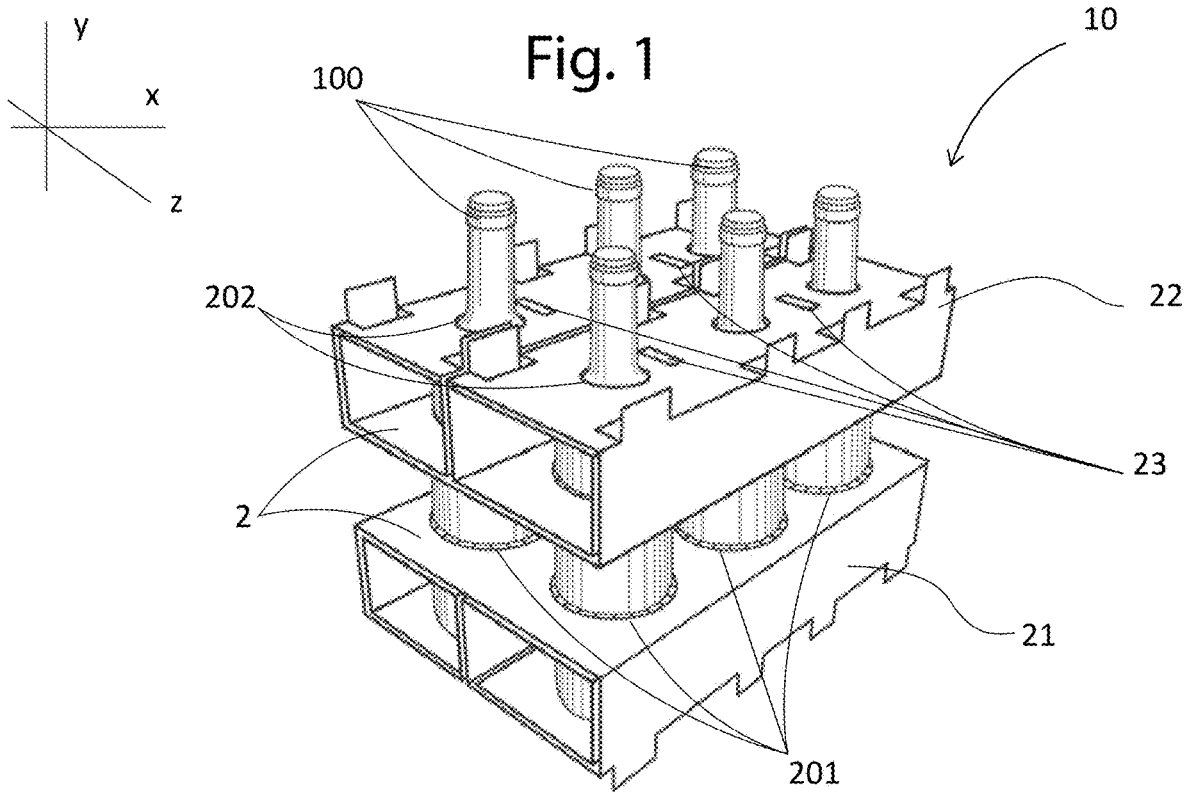
FIG. 1 is a perspective view of a first variant of the inner portion of a first embodiment of the packaging system according to the present invention.

Reference will now be made in detail to embodiments of the invention, one or more examples of which are illustrated in the accompanying drawings. The detailed description uses numerical indications with letters to refer to features in the drawings. Similar or like indications in the drawings and description have been used to refer to similar or like parts of the invention.

With reference to the figures, an improved packaging system is shown, collectively denoted by 10, comprising an outer box 1 and an inner portion 2 configured for interacting with each other.

The outer box 1 develops in height along a direction Y, in width along a direction X, and in depth along a direction Z. The Cartesian plane of reference is illustrated in FIG. 1.

Figure 2:
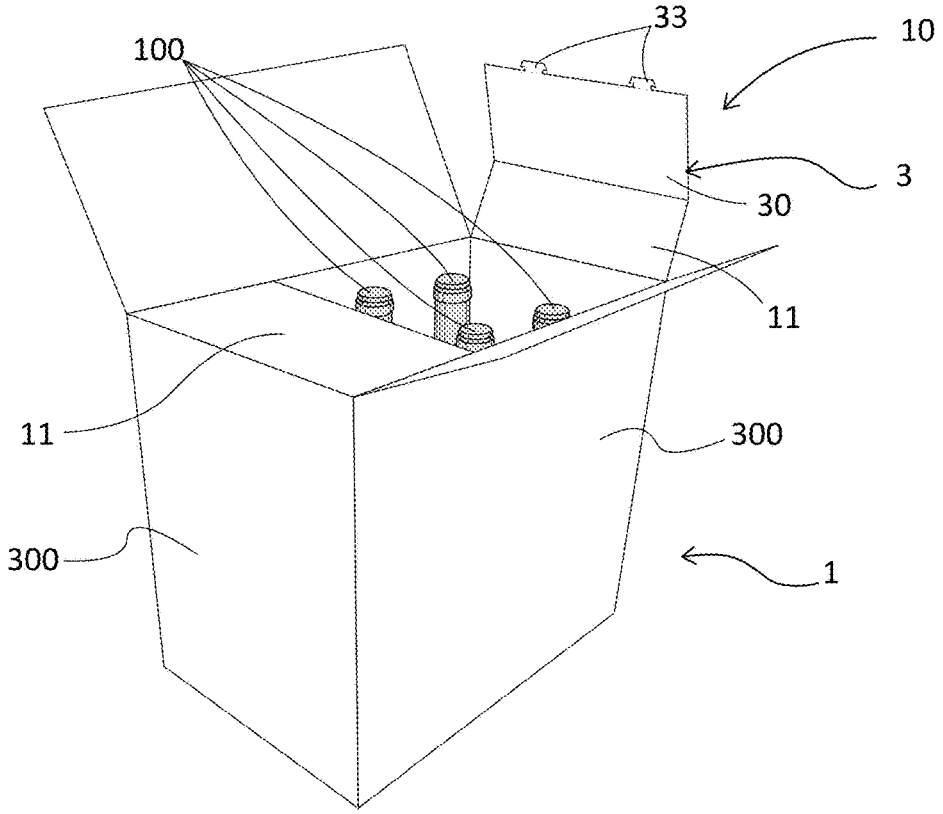
FIG. 2 is a perspective view of a first variant of outer box of the packaging system of FIG. 1.

The box 1 forms a rest base, a top, and one or more flanks 300 which extend between the rest base and the top of the box 1 (FIG. 2, 7).

The box 1 preferably has a shape substantially of a parallelepiped (FIG. 2, 7).

The inner portion 2 comprises two support inserts 21, 22 complementary to the outer box 1, in particular such inserts are configured for supporting one or more objects 100 in such a way as to prevent movement thereof with respect to the outer box 1, in particular they prevent movement thereof with respect to the directions X and Z, but not in the vertical direction of the axis Y.

In general, the packaging 10 comprises one or more support inserts 21, 22; the number of inserts 21, 22 varying depending on the type of objects to be transported.

Preferably, they are two support inserts 21, 22 as in the illustrated embodiment.

According to the present invention, the packaging system 10 comprises an interposing element 3 between the outer box 1 and the inner portion 2 that effectively prevents movement thereof along the direction Y.

Additionally, the support inserts 21, 22 and the interposition element 3 possibly comprise joining means 23, 24, 33 for their mutual coupling.

Figure 16:
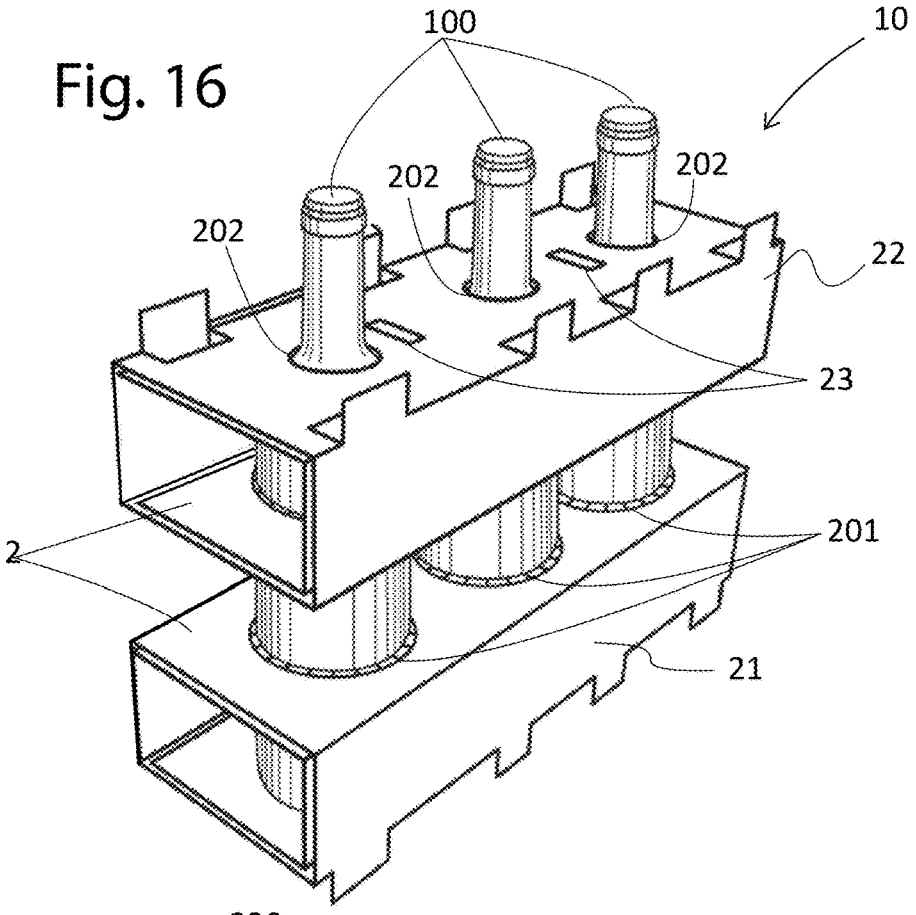
FIG. 16 is a perspective view of the inner portion of an embodiment of the three-bottle packaging system according to the present invention.
Figure 17:
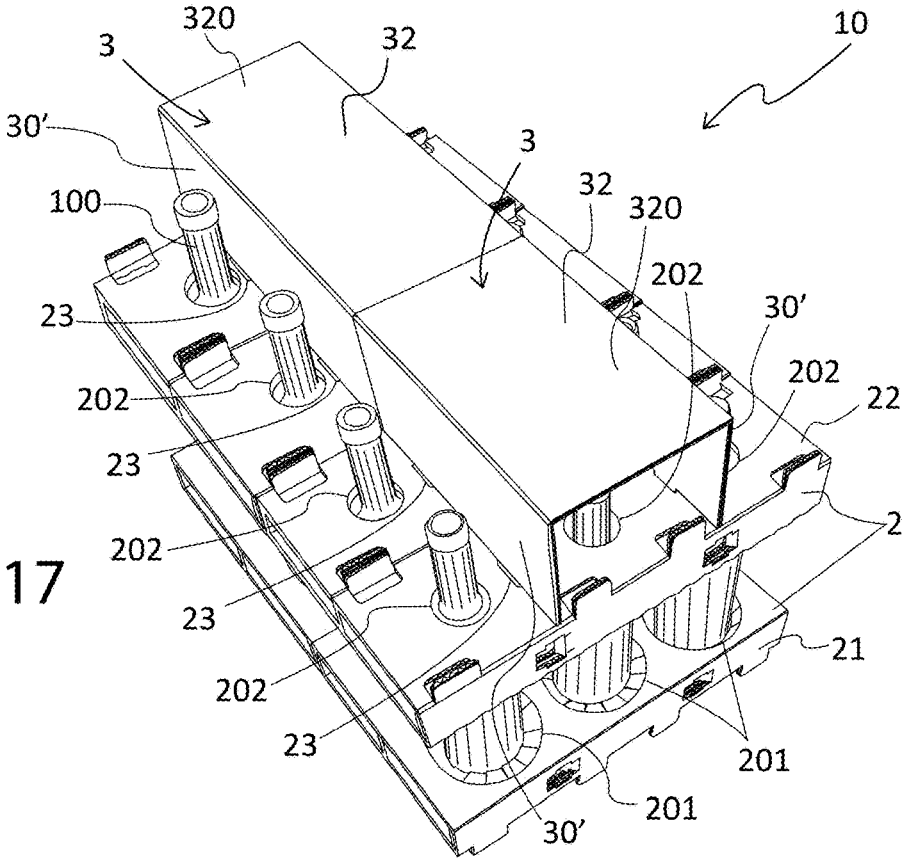
FIG. 17 is a perspective view of the inner portion of an embodiment of the twelve-bottle packaging system according to the present invention.

As can be seen in the attached FIGS. 1 to 15, the packaging system 10 may be configured for transporting six bottles 100, but also, for example, three (FIG. 16) or even twelve bottles 100 (FIG. 17).

In case bottles 100 are transported, the inner portion 2 comprises a first support insert 21, also called lower insert 21, configured for being inserted on the lower portion of the bottles and a second support insert 22, also called upper insert 22, configured for being inserted at the neck of the bottles.

The terms lower and upper refer to the position of the packaging system so as to keep the bottles in their normal orientation.

In this case, the first support insert 21 is placed at the lower part of the bottles and therefore at the lower wall of the outer box 1 while the second support insert 22 abuts on one side against the shoulders of the bottles and on the opposite side against the interposition element 3.

In a first embodiment of the packaging system 10, illustrated in FIGS. 1 to 10, the interposition element 3 is integrated with the outer box 1.

In particular, the interposition element 3 extends from at least one flap 11 of the outer box 1, preferably it extends from two opposite flaps 11.

Figure 3:
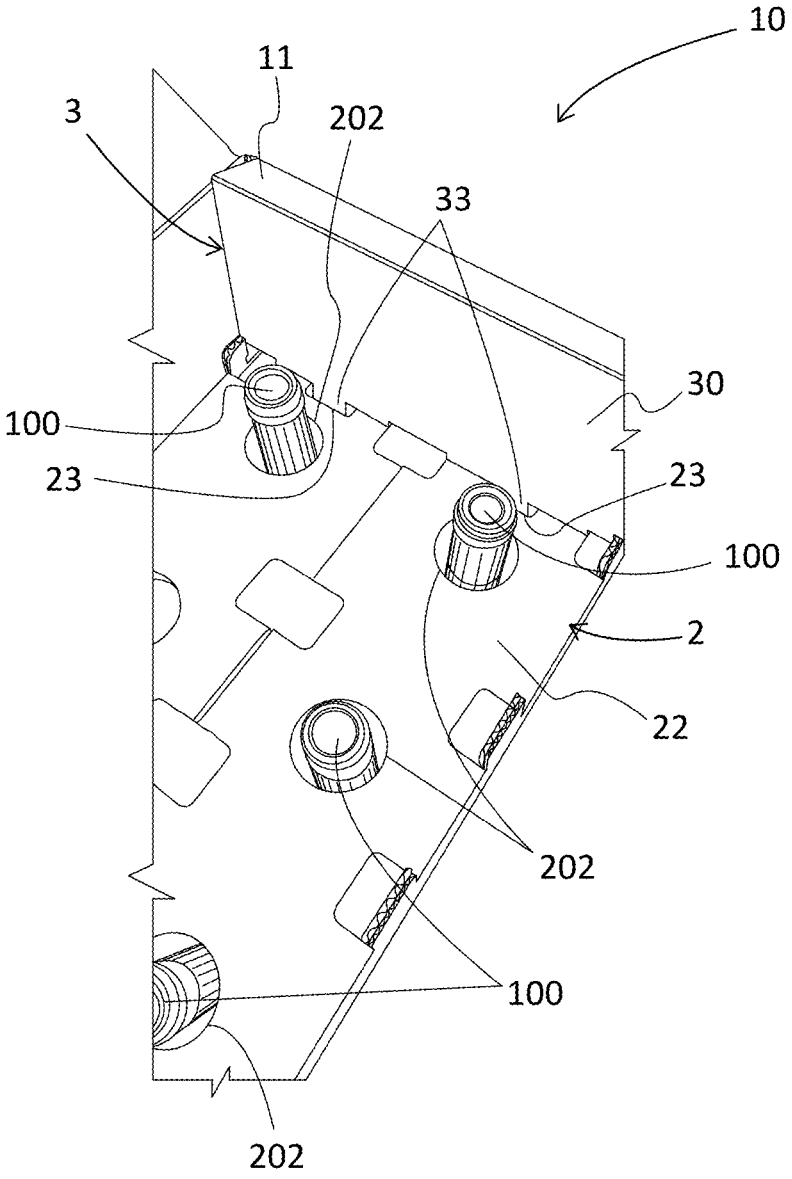
FIG. 3 is a view of a detail of the system of a first integration combination between the inner portion of FIG. 1 and the outer box of FIG. 2.
Figure 4:
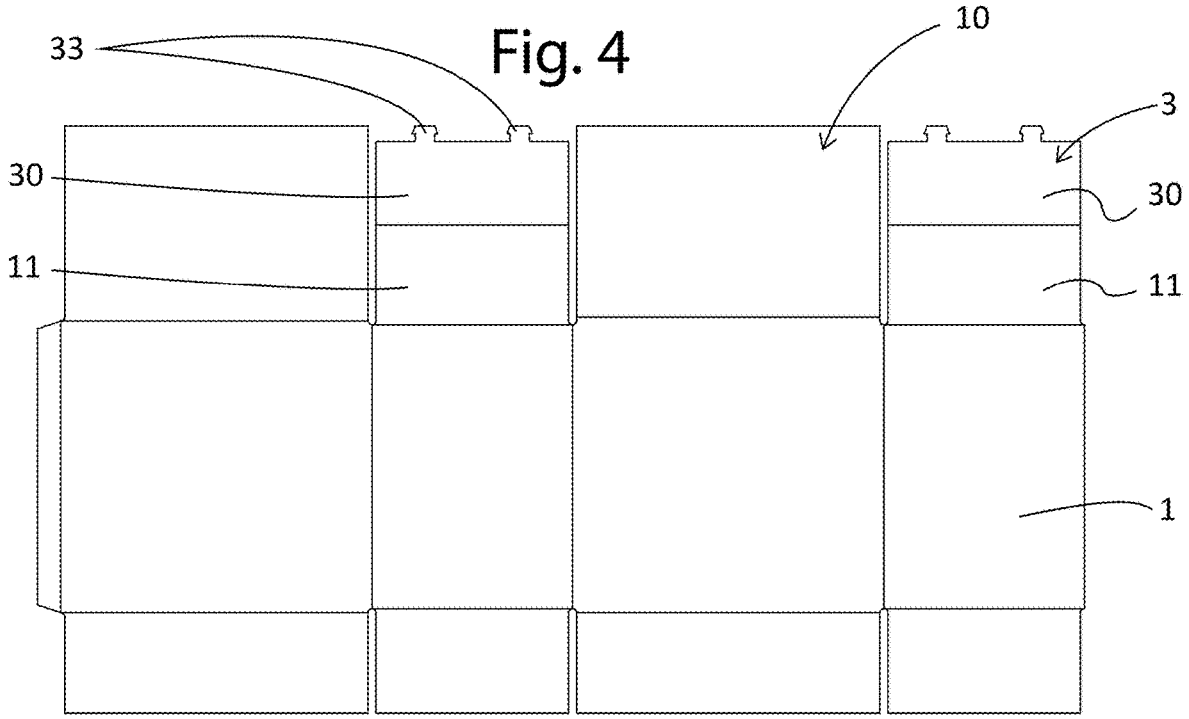
FIG. 4 is a view of the plane configured for making the box of FIG. 2.

In the illustrated embodiment, it extends from the smaller flaps 11 of the outer box 1 (FIGS. 2, 3 and 4).

The interposition element 3 is represented by a prolongation 30 of the two smaller flaps 11 of the outer box 1, which, once folded, abut against the upper support insert 22.

In particular, said prolongations 30 extend along a length substantially equivalent to the distance between the support insert 22 and the top of the outer box 1, such that once said interposition element 3 is positioned and the box is closed, the inner portion 2, consisting of the support inserts 21 and 22, will prevent the movement of the bottles 100 along the axes X and Z and the interposition element 3 will prevent the support inserts 21, 22 from moving along the axis Y.

Figure 4A:
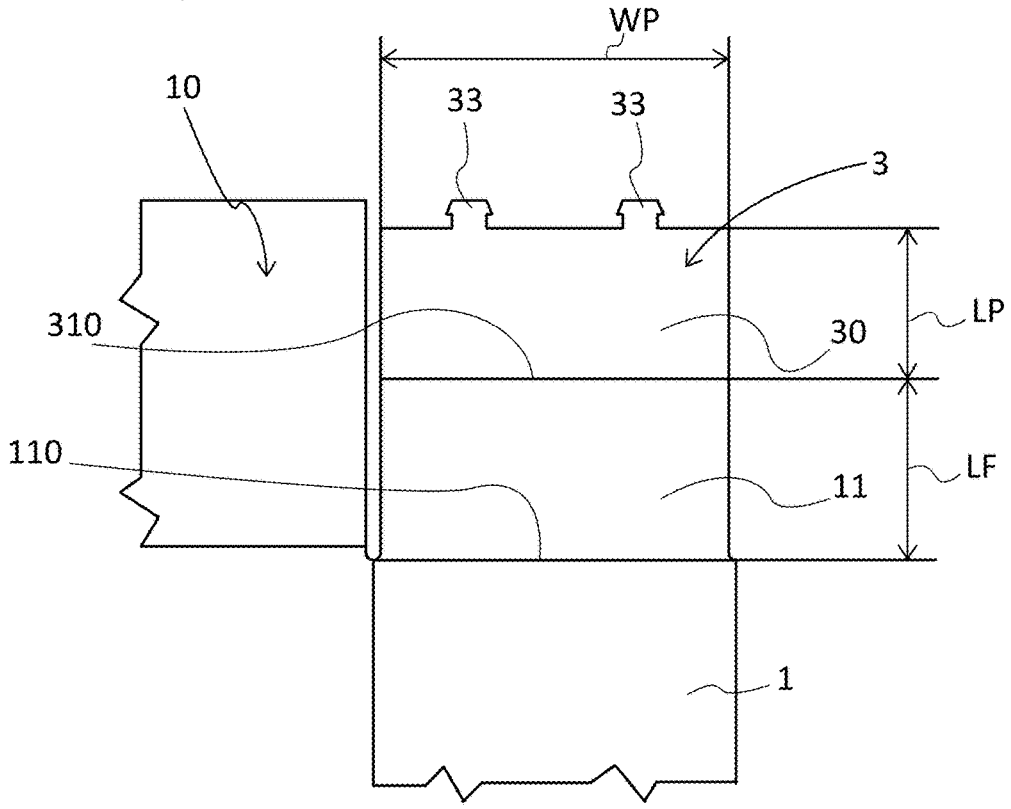
FIG. 4A shows a detail of the view of FIG. 4.

As shown for example in FIG. 4A, each flap 11 and the relative prolongation 30 are preferably separated from each other and delimited by a first fold line 310, which allows the prolongation 30 to rotate and fold with respect to the flap 11, essentially acting as a film hinge.

The flap 11 is preferably separated from the rest of the box 1 by a second fold line 110, which allows the flap 11 to rotate and fold with respect to the box 1, essentially acting as a film hinge.

The length LF of the flap 11 and the length LP of the prolongation 30 are measured according to a direction perpendicular to the fold line 110 and the fold line 310, respectively.

Preferably, the length LF of the flap 11 is equal to or greater than 0.3 times the length LP, and more preferably equal to or greater than 0.5 times, or 0.8 times the length LP, and more preferably comprised between 0.3-2 times or between 0.5-1.5 times or between 0.8-1.2 times the length LP.

Such dimensions allow the flaps 11 to better and more robustly protect the bottles 100 or other objects contained in the box 1.

When the packaging system is completed or however assembled, each flap 11 extends preferably in a plane or other surface which is substantially parallel or longitudinal to the rest base and/or the top of the closed box 1.

In a second alternative embodiment of the packaging system 10, illustrated in Figures from 11 to 17, the interposition element 3 is vice versa constituted by a third element external to the box 1 configured for being inserted between the upper support insert 22 and the top of the outer box 1.

In particular, a first variant of this embodiment of the interposition element 3 (FIGS. 11, 12 and 13) includes a crown element 31 while a second variant (FIGS. 14 and 15) includes a bridge element 32.

Said crown member 31 advantageously comprises one or more walls that, in the improved packaging system, extend according to a direction substantially parallel or otherwise longitudinal to the flanks 300 of the box 1.

Figure 11:
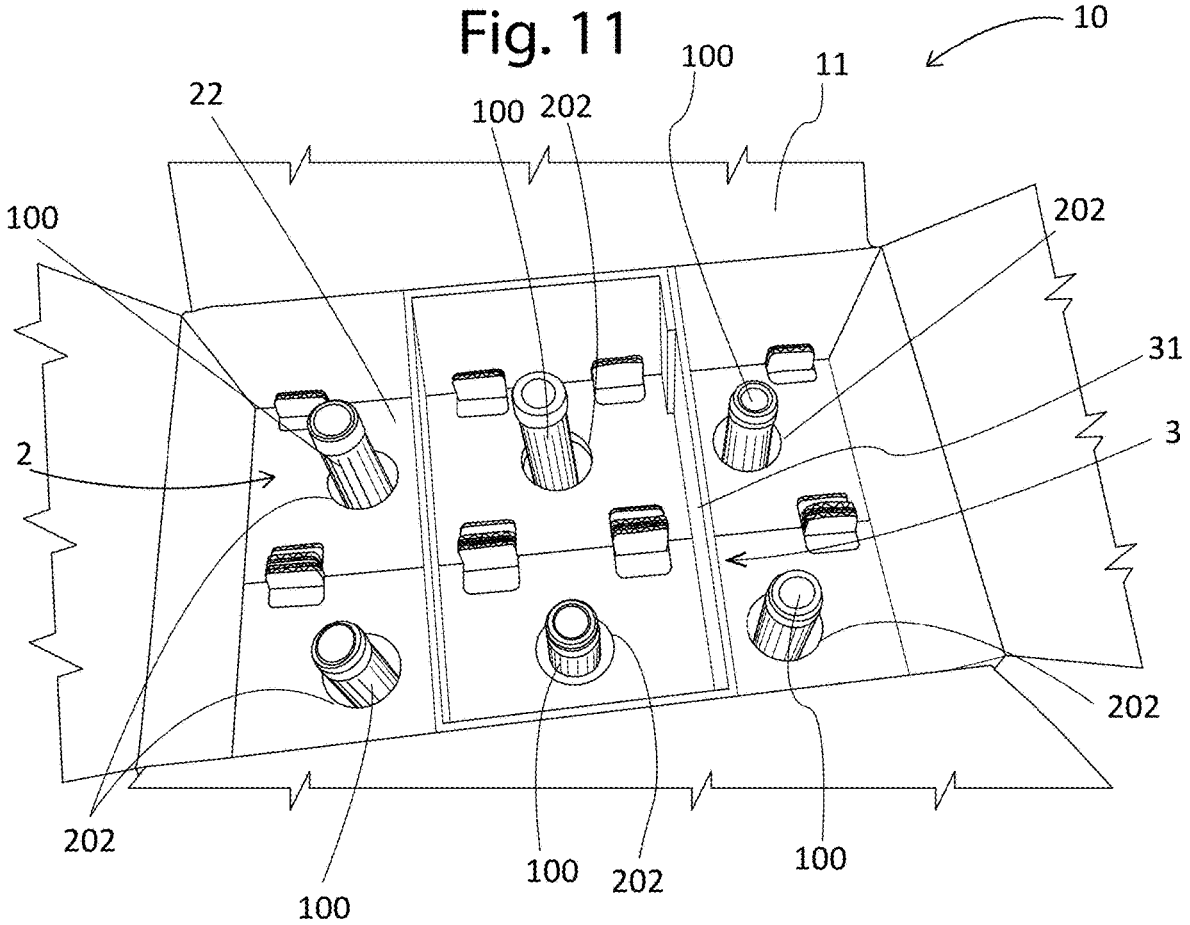
FIG. 11 is a top view of a first variant of a second embodiment of the packaging system according to the present invention.
Figure 12:
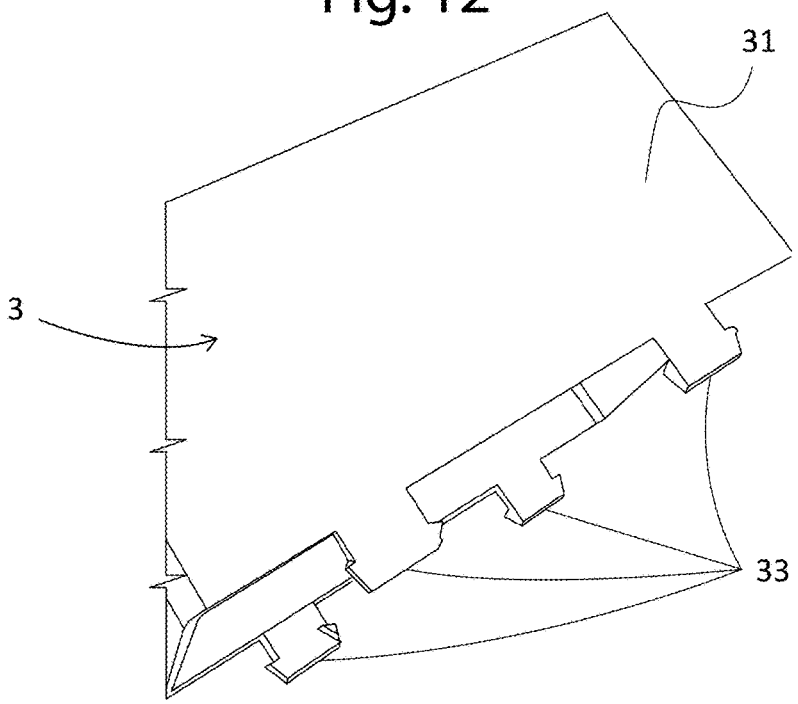
FIG. 12 is a view of a detail of the interposition system of FIG. 11.
Figure 13:
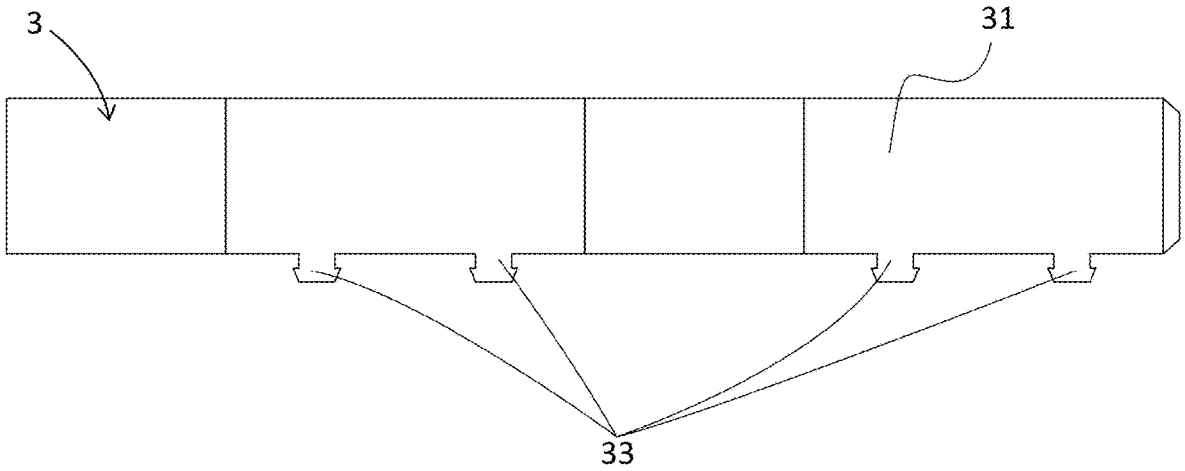
FIG. 13 is a plan view of the plane configured for making the interposition system of FIGS. 11 and 12.

By this it is for example meant, that when the crown element 31 and the box 1 have shapes substantially of a parallelepiped (FIG. 2, 7, 11), either prismatic or cylindrical, the generatrix straight lines of the parallelepiped, prism or cylinder formed by the crown 31 and the generatrix straight lines of the parallelepiped, either prism or cylinder formed by the box 1 are parallel to each other or otherwise longitudinal (FIG. 11).

In the completed or however assembled improved packaging system the crown element 31 can completely surround one or more necks of the bottles contained in the box 1 (FIG. 11) or extend around said bottles without completely surround them.

The crown element 31 preferably has a substantially tubular shape (FIG. 11) and comprise for example a completely or partially open bottom and a completely or partially open top.

Also in such second embodiment of the system 10, once the interposition element 3 is positioned and the outer box 1 is closed, the latter blocks the movements along the direction Y of the support inserts 21, 22 and of the objects to be transported 100.

Figure 14:
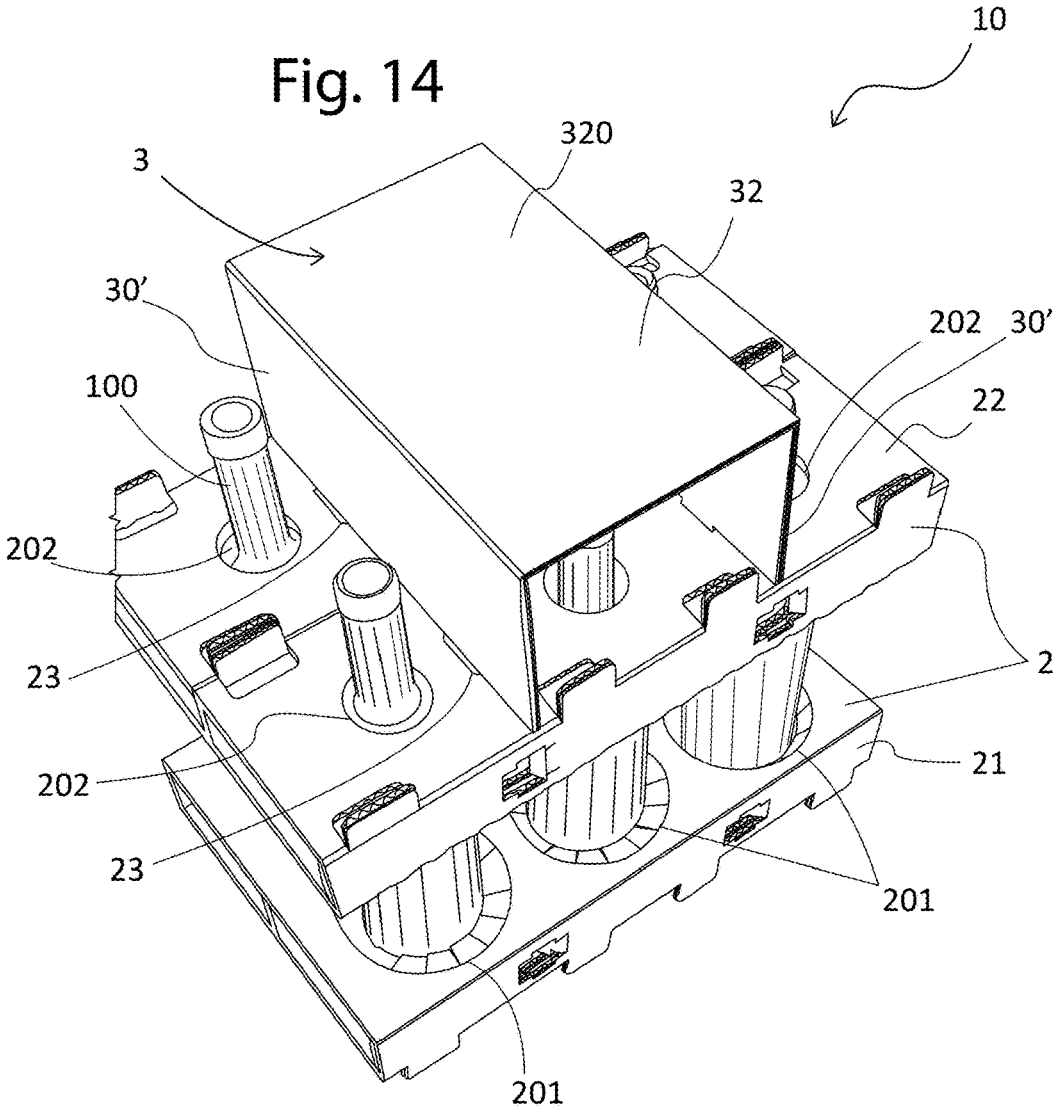
FIG. 14 is a top view of a second variant of a second embodiment of the packaging system according to the present invention.
Figure 15:
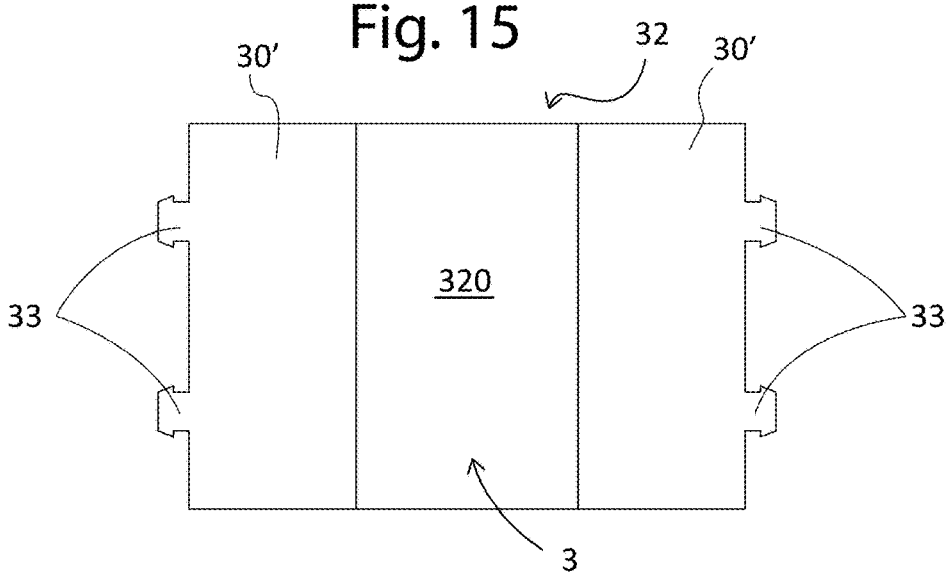
FIG. 15 is a first plan view of the plane configured for making the interposition system of the packaging system according to FIG. 14.

The bridge element 32 that possibly forms or is otherwise part of the interposition element 3 preferably comprises a portion of rest flap 320 and two prolongations 30', extending from two mutually opposite sides of the portion of rest flap 320 (FIG. 14, 15, 17).

The portion of rest flap 320 preferably extends in a plane or other surface substantially perpendicular or otherwise transverse to the two or more prolongations 30'.

The portion of rest flap 320 preferably extends in a plane or other surface substantially parallel to the rest base and/or the top of the closed box 1.

The portion of rest flap 320 may extend into, for example, a plane or other surface substantially parallel or longitudinal to the base and/or to the top of the closed box 1.

When the packaging system is finished or otherwise assembled, the portion of rest flap 320 may extend, for example, above or otherwise around the necks of part of the bottles 100 or other objects contained in the box 1 and/or fixed to and held in place by the support insert 22; for example, the portion of rest flap 320 may extend above or otherwise around two, three, or four bottle necks 100, or around two, three, or four bottles 100 or other objects contained while the box 1 contains a greater number of such objects 100.

The prolongations 30, 30' advantageously lie in planes or other surfaces substantially parallel or otherwise longitudinal to the flanks 300 of the box 1 (FIG. 3, 8, 14, 15, 17): thus, the prolongations 30, 30' strengthen the improved packaging system more against crushings and drops—for example, when it drops upside down—than for example in the cases in which the prolongations 30, 30' are substantially inclined with respect to the flanks 300 of the box 1.

For this purpose, the prolongations 30, 30' are considered to be substantially longitudinal to the flanks 300 of the box 1 if they have an inclination with respect thereto equal to or less than 45°, more preferably equal to or less than 30°, more preferably equal to or less than 20° or 10°, 5° or 2°.

Figure 15A:
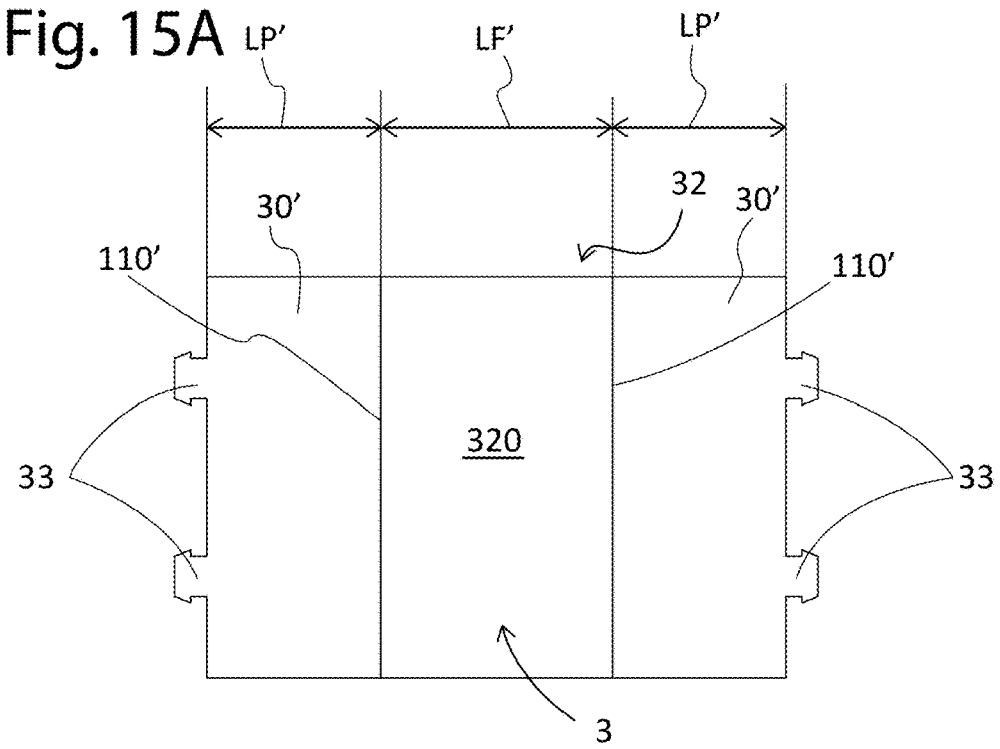
FIG. 15A is a second plan view of the plane configured for making the interposition system of the packaging system according to FIG. 14.

As shown for example in FIG. 15A, the bridge member 32 and each prolongation 30' are preferably separated from each other and delimited by a fold line 110', which allows the relative prolongation 30' to rotate and fold with respect to the bridge element 32, substantially acting as a film hinge.

The length LF of the flap 11 and the length LP of the prolongation 30 are measured according to a direction perpendicular to the fold line 110 and the fold line 310, respectively.

Preferably, the length LF' of the bridge element 32 is equal or greater than 0.3 times the length LP', and more preferably equal or higher than 0.5 times, or 0.7 times the length LP', and more preferably comprised between 0.3-3 times or between 0.5-2 times, between 0.7-1.2 times or between 0.74-0.76 times the length LP'.

Such dimensions allow the bridge element 32 to better and more robustly protect the bottles 100 or other objects contained in the box 1, for example by containing or enclosing the bottles 100 or other objects, for example by containing or enclosing the bottles 100 or other objects.

In both embodiments, that is, in the one in which the interposition element 3 is integrated with the outer box 1 (from FIG. 1 to FIG. 10) and both in the one in which it is a third element (from FIG. 11 to FIG. 15), the at least one interposition element 3 may comprise protuberances 33 configured for being inserted into respective holes 23 and made on the support insert 22. This type of coupling is illustrated in FIGS. 2 and 3 but also 12, 13, 14 and 17.

Each protuberance 33 or more generally each interposition element 3 may be for example arranged to hook with holes 23, for example, because they are hook-shaped or form other undercut portions.

Alternatively, each protuberance 33 may be simply inserted by friction, i.e., fitted with a slight forcing—for example, fitted by hand—into the respective holes 23, or glued.

Figure 6:
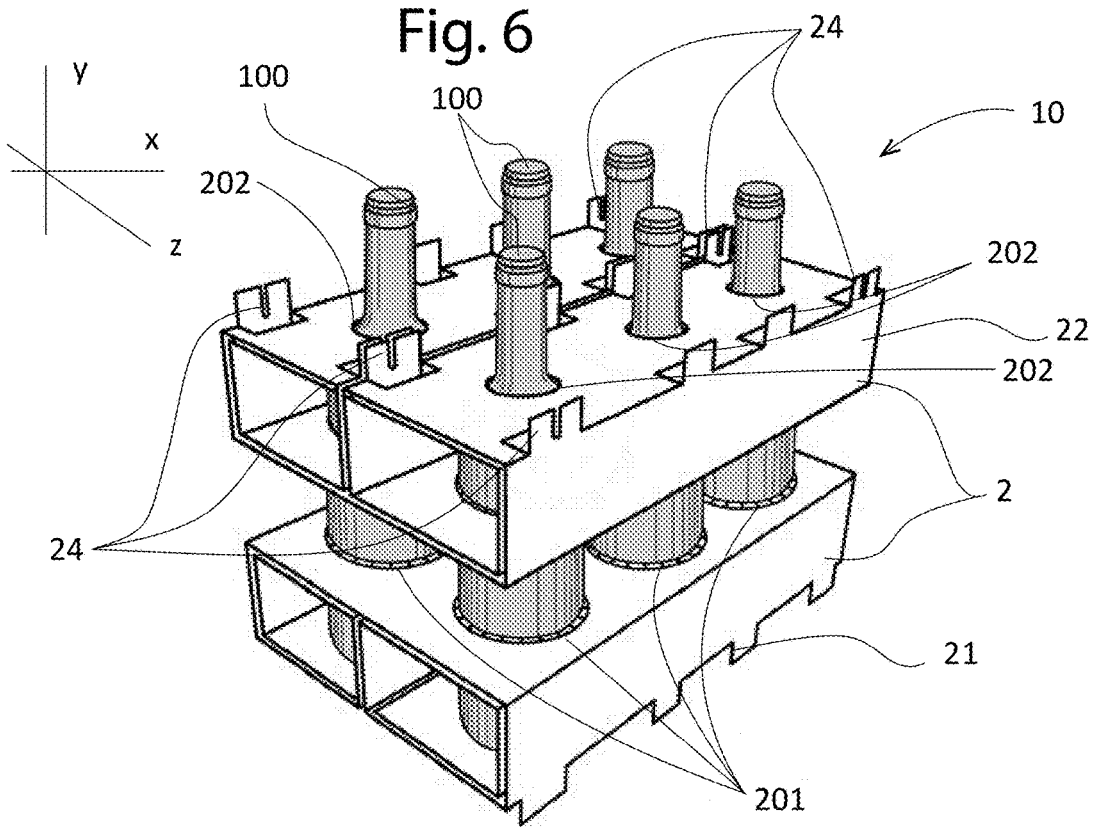
FIG. 6 is a perspective view of a second alternative variant of the inner portion of the first embodiment of the packaging system according to the present invention.
Figure 7:
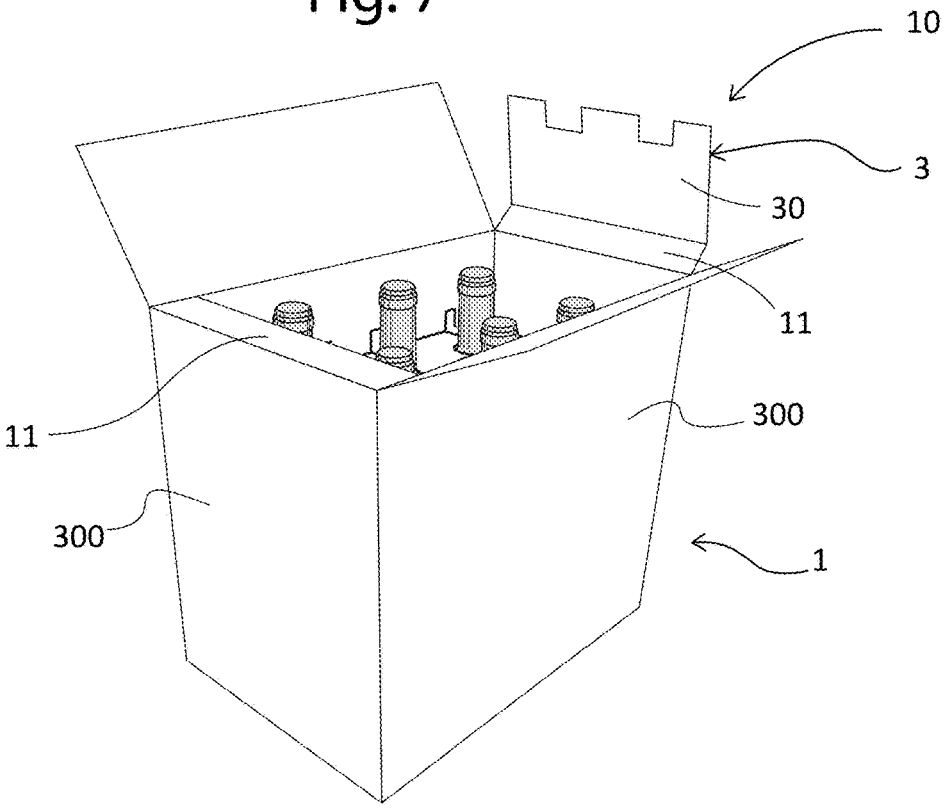
FIG. 7 is a perspective view of a second variant of outer box of the packaging system of FIG. 6.
Figure 8:
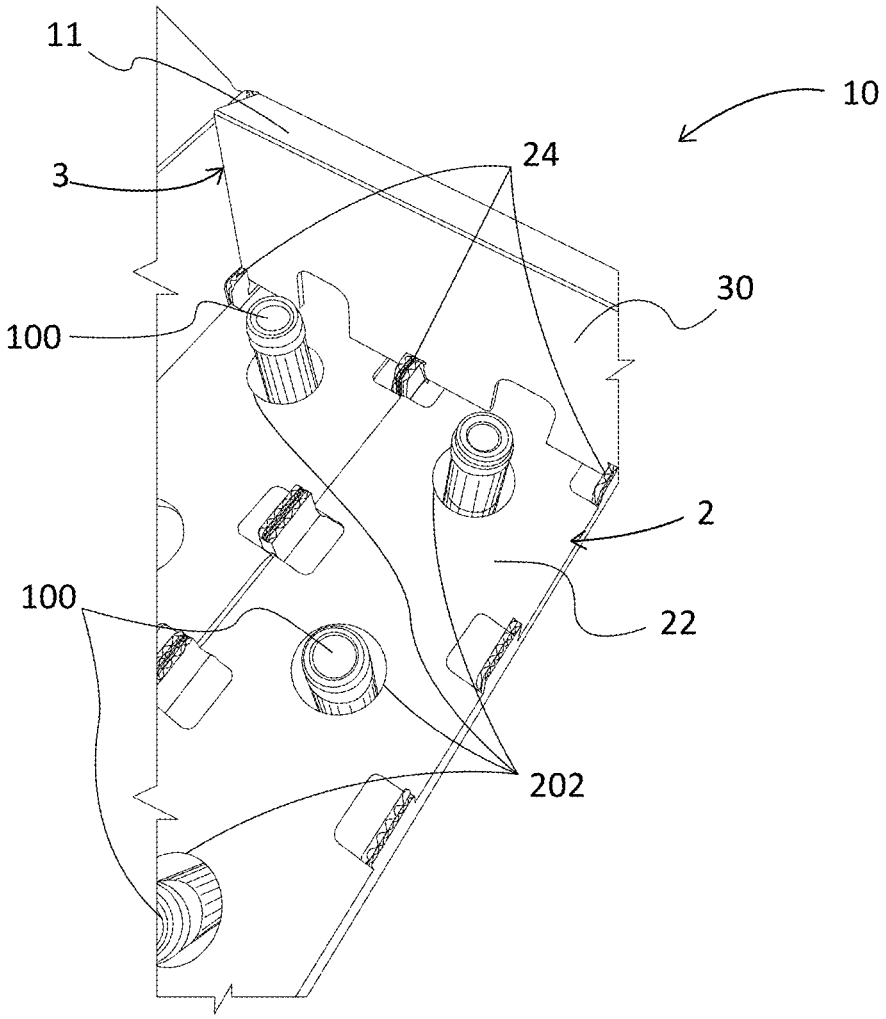
FIG. 8 is a view of a detail of the system of a second integration combination between the inner portion of FIG. 6 and the outer box of FIG. 7.
Figure 9:
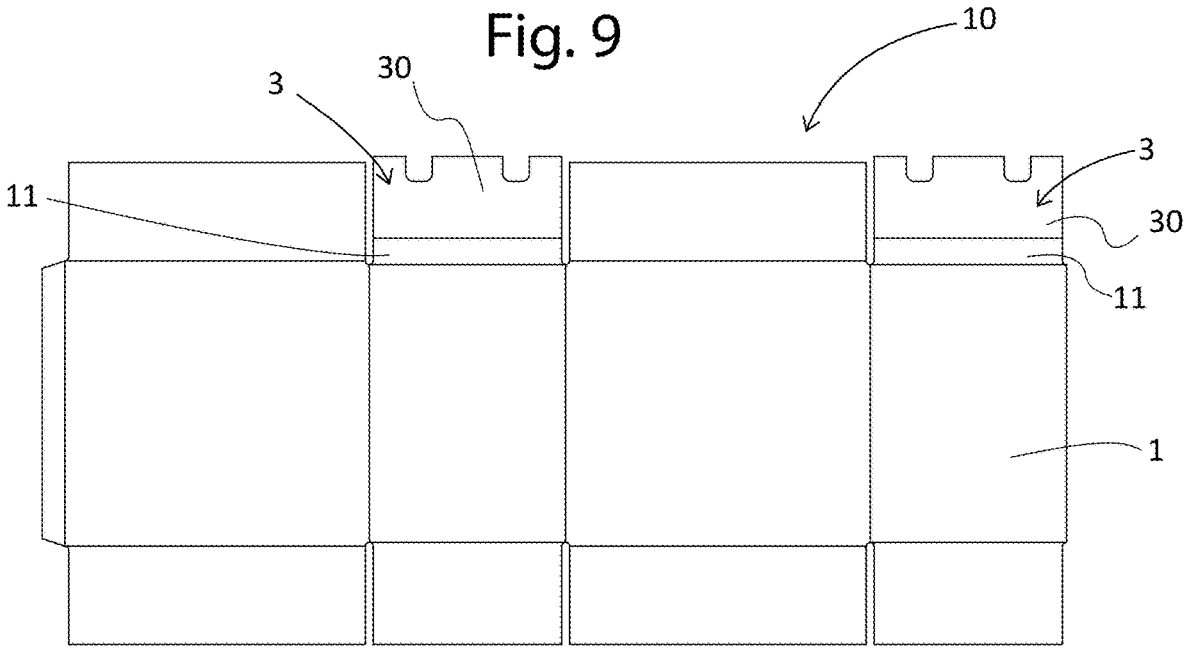
FIG. 9 is a view of the plane configured for making the outer box of FIG. 7.

Alternatively, the coupling between the interposition element 3 and the support insert 22 is made by inserting the latter into respective slotted coupling elements 24 protruding from said support insert 22. This possibility is illustrated in FIGS. 6-8.

Advantageously, the support inserts 21, 22 are identical and arranged specularly with each other, which allows both inserts to be obtained with a single and the same manufacturing process thereby increasing efficiency thereof.

In addition, the fact that the upper 22 and lower 21 inserts are identical makes it possible to further reduce the number of stock references to be stored required for the final assembly of the packaging system 10 compared to current professional packagings.

Figure 5:
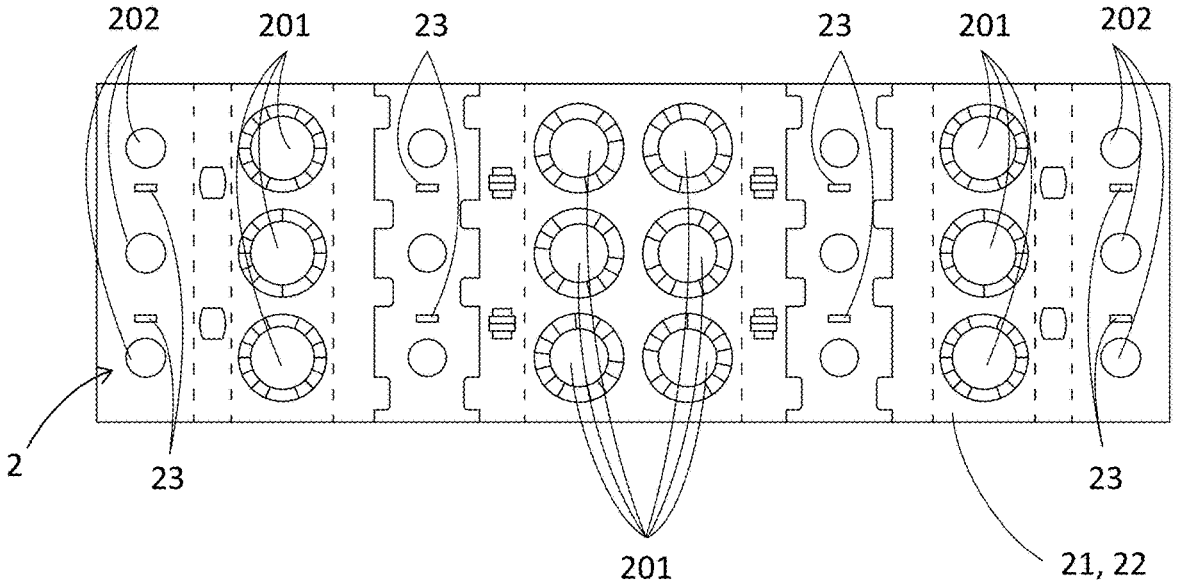
FIG. 5 is a plan view of the plane configured for making one of the support inserts of FIG. 1.
Figure 10:
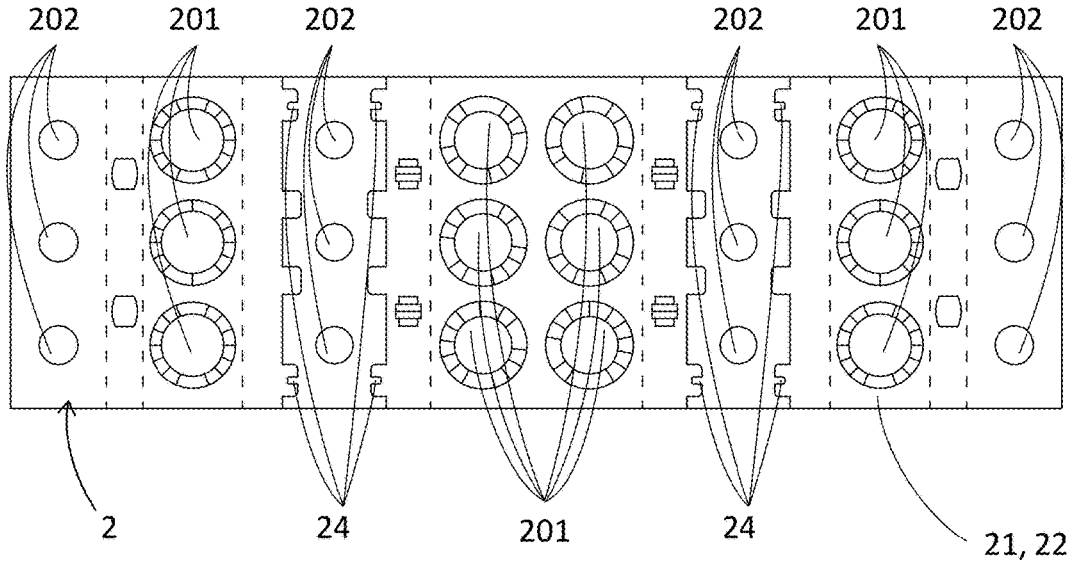
FIG. 10 is a plan view of the plane configured for making the support inserts of FIG. 6.

In fact, both support inserts 21, 22 are made from a plane like the one illustrated in FIG. 5 and in the other variant of FIG. 10.

In particular, as shown in FIG. 1 and in its possible variant of FIG. 6, the support inserts 21 and 22 have the shape substantially of a parallelepiped having at least one through opening 200 formed by holes 201 and 202, wherein, a first hole 201, is present on a first side of the parallelepiped with a diameter configured for housing the bottom of the bottles 100, whereas a second hole 202 placed on the opposite side of the parallelepiped having a smaller diameter configured for allowing only and exclusively the passage of the neck of the bottles 100.

The configuration of the support inserts 21, 22 allows to be used for the transport of bottles as a first support insert 21 will be located in the lower part by fitting these bottles only through the holes 201 as the bottles will rest on the inner side of the parallelepiped, without being able to pass through the hole 202 being diametrically extremely smaller.

As far as the second support insert 22 is concerned, this will be positioned at the upper part of the bottles by inserting it starting from the upper end of the bottles and sliding it until the hole 202 abuts with the shoulder of the bottle (this aspect is clearly visible in FIGS. 1,6 and 16).

The illustrated embodiment allows the transport of 6 bottles, however the improved packaging 10 may be configured for the transport of a different number of bottles such as 1, 3, 4 or 12 by using support inserts comprising equivalent numbers of through openings. See, for example, FIGS. 16 and 17.

Advantageously, the second embodiment of the improved packaging 10, being composed of an interposition element 3 external to and not integrated with the box 1, may be used for any type of outer box 1 having dimensions compatible internally with the support inserts 21, 22.

The improved packaging 10 can be made of cardboard but also of any other material.

Advantageously, cardboard allows obtaining a type of packaging 10 that is easily disposable and transportable.

When the packaging 10 is made of cardboard, the packaging components can be transported in a flat form and then assembled on site, which can drastically reduce transportation costs (FIGS. 4, 5, 9, and 10).

It is also possible to make the outer box 1 of one material such as wood and the inner portion 2 of another material such as cardboard.

Advantageously, the packaging system 10 can be configured for the transport of any number of bottles, depending on how it is configured.

For example, there may be provided 1, 2, 3, 4, 6 through openings 200 on said support inserts 21, 22 and an outer box 1 having compatible dimensions.

The operation of the improved packaging 10 is clear and obvious from what is described.

From the above description the features of the system object of the present invention, as well as the advantages thereof, are evident.

Finally, it is clear that the system thus conceived is susceptible to numerous modifications and variations, all of which are within the scope of the invention; for example, the one or more protuberances 33 may be made on the support insert 22, the holes 23 may be made on the prolongations 30, 30', the protuberances being arranged 33 to be inserted into the respective holes 23.

Furthermore, all of the details can be replaced by technically equivalent elements.

In practice, the materials used, as well as their dimensions, can be of any type according to the technical requirements.

The invention claimed is:

1. Improved packaging system comprising an outer box and an inner portion configured for interacting with each other, said outer box developing in height along a direction Y, in width along a direction X and in depth along a direction Z, said inner portion comprising one or more support inserts complementary to said outer box, said inserts being configured for supporting one or more objects in such a way as to prevent movement thereof with respect to said outer box, in particular with respect to said directions X and Z, wherein said packaging system comprises at least one interposition element between said outer box and said inner portion so as to prevent movement along said direction Y of the assembly formed by said support inserts and said objects with respect to said outer box, said support inserts and said at least one interposition element comprising coupling means for their mutual coupling;

wherein at least one of the following (i), (ii) or (iii) is satisfied:

(i) said at least one interposition element is configured for being inserted into respective slotted elements protruding from said support insert;

(ii) the support insert forms holes and the at least one interposition element comprises protuberances configured for being inserted into said holes; and/or (iii) the coupling between the interpositional element and the support insert is made by inserting the support insert into respective slotted coupling elements protruding from said support insert;

wherein said interposition element is integrated with said outer box; and wherein said interposition element extends from at least one flap of said outer box.

2. Packaging system according to claim 1 wherein said one or more objects are one or more bottles and said inner portion comprises a first support insert configured for being inserted on the lower portion of said bottles and a second support insert configured for being inserted at the neck of said bottles.

3. Packaging system according to claim 1 wherein said interposition element extends from two opposite flaps of said outer box.

4. Packaging system according to claim 1 wherein said at least one interposition element comprises protuberances configured for being inserted into corresponding holes made on said support insert.

5. Packaging system according to claim 1 wherein said at least one interposition element is configured for being inserted into respective slotted coupling elements protruding from said support insert.

6. Packaging system according to claim 1 wherein said support inserts are identical and arranged specularly with each other.

7. Packaging system according to claim 1 wherein said support inserts have the shape substantially of a parallelepiped having at least one through opening formed by two holes, wherein a first hole formed on a first side of said parallelepiped has a small diameter while a second hole formed on the opposite side of said parallelepiped has a larger diameter.

8. Packaging system according to claim 1 wherein said support inserts have 1, 2, 3, 4, 6 or more through openings.

9. Packaging system according to claim 2 wherein the outer box forms one or more flaps, the interposition element is formed or otherwise comprises a prolongation of one or more of said flaps, at least part or all of said prolongations extend along a length substantially equivalent to the distance between the second support insert and the top of the outer box.

10. Packaging system according to claim 1 wherein the outer box forms one or more flaps, the interposition element is formed or otherwise comprises a prolongation of one or more of said flaps, each prolongation lies in a plane or other surface substantially parallel or otherwise longitudinal to the flanks of the box.

* * * * *